US008620188B2

(12) United States Patent
Yoshida

(10) Patent No.: US 8,620,188 B2
(45) Date of Patent: Dec. 31, 2013

(54) IMAGE FORMING APPARATUS HAVING A SPECIAL COLOR IMAGE MODE

(75) Inventor: Ken Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 365 days.

(21) Appl. No.: 13/072,082

(22) Filed: Mar. 25, 2011

(65) Prior Publication Data

US 2011/0249992 A1 Oct. 13, 2011

(30) Foreign Application Priority Data

Apr. 9, 2010 (JP) ..... 2010-090452
Oct. 22, 2010 (JP) ..... 2010-237028

(51) Int. Cl.
*G03G 15/01* (2006.01)
*G03G 15/00* (2006.01)

(52) U.S. Cl.
USPC ..... 399/228; 399/43; 399/299

(58) Field of Classification Search
USPC ..... 399/43, 54, 223, 228, 231, 299, 302, 399/303; 347/115, 117, 118
See application file for complete search history.

(56) References Cited

U.S. PATENT DOCUMENTS 4,639,122 A 1/1987 Pease
5,066,988 A 11/1991 Miyake
7,003,238 B2 2/2006 Yoshida et al.
7,162,179 B2 1/2007 Yoshida
7,203,433 B2 4/2007 Kato et al.
7,280,792 B2 10/2007 Sawai et al.
7,542,713 B2 6/2009 Yoshida
7,567,775 B2 * 7/2009 Fukuhara ..... 399/302
7,610,004 B2 10/2009 Kato et al.
7,639,976 B2 12/2009 Yoshida
7,813,662 B2 10/2010 Muto et al.

(Continued)

FOREIGN PATENT DOCUMENTS

JP 2001305818 A * 11/2001
JP 2004-219613 8/2004

(Continued)

OTHER PUBLICATIONS

Extended European Search Report issued Jul. 13, 2011, in Patent Application No. 11160577.0.

*Primary Examiner* — Robert Beatty
(74) *Attorney, Agent, or Firm* — Oblon, Spivak, McClelland, Maier & Neustadt, L.L.P.

(57) ABSTRACT

An image forming apparatus includes a first image carrier forming a black toner image, a plurality of second image carriers forming a yellow, magenta, or cyan toner image, a third image carrier forming a special color toner image, and a transfer target member or an intermediate transfer belt. The apparatus further includes first and second detachment units. The first detachment unit detaches only the third image carrier from the transfer target member, and the second detachment unit detaches the second image carriers and the third image carrier. When switching from a special color image mode to either a normal color image mode or a monochrome image mode is performed during continuous printing of the recording media, the first detachment unit or the second detachment unit controls the detachment operation based on the number of recording media continuously printed by the normal color image mode or the monochrome image mode.

14 Claims, 7 Drawing Sheets

(56) References Cited

U.S. PATENT DOCUMENTS

| | | | |
|---|---|---|---|
| 2008/0088883 | A1 | 4/2008 | Yoshida |
| 2008/0317518 | A1 | 12/2008 | Fukuhara |
| 2009/0016784 | A1 | 1/2009 | Yoshida |
| 2009/0196661 | A1 | 8/2009 | Yoshida |
| 2010/0080631 | A1 | 4/2010 | Ogiyama et al. |
| 2010/0098446 | A1 | 4/2010 | Ishikawa et al. |
| 2010/0266300 | A1 | 10/2010 | Yoshida |

FOREIGN PATENT DOCUMENTS

| | | | | |
|---|---|---|---|---|
| JP | 2004-258512 | | | 9/2004 |
| JP | 2005035133 | A | * | 2/2005 |
| JP | 2005111770 | A | * | 4/2005 |
| JP | 3750678 | | | 12/2005 |
| JP | 2006-171233 | | | 6/2006 |
| JP | 2006-267706 | | | 10/2006 |
| JP | 2010002638 | A | * | 1/2010 |

* cited by examiner

IMAGE FORMING APPARATUS HAVING A SPECIAL COLOR IMAGE MODE

CROSS-REFERENCE TO RELATED APPLICATIONS

The present application claims priority from Japanese patent application numbers 2010-090452 and 2010-237028, filed on Apr. 9, 2010 and Oct. 22, 2010, respectively, the entire contents of which are incorporated by reference herein.

BACKGROUND OF THE INVENTION

1. Field of the Invention

The present invention relates to an image forming apparatus such as a copier, printer, facsimile machine, or multifunctional apparatus combining two or more of the above functions, and in particular to an image forming apparatus employing a special color of toner.

2. Description of the Related Art

In image forming apparatuses such as copiers, printers, or facsimile machines, there is a conventionally known transfer technology in which special toner such as a transparent toner or white toner is used together with a plurality of color toners, and toner images formed of the plurality of color toners and the special color toner are superimposedly transferred to, for example, an intermediate transfer belt.

The image forming apparatus in which the toner image is formed using such special toner is configured to enable a user to switch between a normal full-color image mode, monochrome or black and white image mode, and special color or five-color image mode depending on the type of the original document or image data.

More specifically, when forming a color image or color image data of standard four colors (YMCK), a normal color image mode is selected in which a toner image of black toner and color toner images of yellow, magenta, and cyan are superimposed on the intermediate transfer belt, the transfer target member. When forming a monochrome image or image data, a monochrome image mode is selected in which toner images of black toner only are superimposed on the intermediate transfer belt. Further, when forming a color image including a special color (or color image data including a special color), a toner image of black toner, color toner images of yellow, magenta, and cyan, and a toner image of particular color are superimposed on the intermediate transfer belt.

In addition, when switching between various modes, a photoreceptor drum which is not used for image formation is separated from the intermediate transfer belt on which the special toner image is to be formed.

To be more specific, when the normal color image mode is selected, the photoreceptor drum on which the special color toner image is to be formed is separated from the intermediate transfer belt, and the photoreceptor drum on which a black toner image is formed and the three photoreceptor drums each on which a toner image of one of three colors (YMC) is formed come in contact with the intermediate transfer belt. In addition, when the monochrome image mode is selected, the photoreceptor drum to form a particular toner image and the three photoreceptor drums on each of which a toner image of one of three colors (YMC) is formed are separated from the intermediate transfer belt, and only the photoreceptor drum on which a black toner image is formed comes in contact with the intermediate transfer drum. Further, when a particular color image mode is selected, all of the photoreceptor drums on which a particular toner image is to be formed, the photoreceptor drum on which a black toner image is formed, and the three photoreceptor drums each on which a toner image of each of three colors (YMC) is formed come in contact with the intermediate transfer belt.

When, in the conventional image forming apparatuses, an operation to print various, mixed original images or image data is performed in one job continuously, switching between the normal color image mode, monochrome image mode, and special color image mode requires an operation to separate the photoreceptor drum (image carrier) from the intermediate transfer belt (transfer target member) while a continuous print job is being performed. Such a separation operation saves wear and tear on the imaging section which is not used in the image formation, but with the disadvantage that productivity of the image formation in the continuous print operation is degraded.

As a remedy for the above problem, images can be formed during separation of the photoreceptor drum or after completion of separation. However, since image formation is performed by the switched-over mode in a state in which the intermediate transfer belt is still vibrating due to the contacting and separating movement, abnormal images including color shift or uneven pitch may be formed on the output image.

SUMMARY OF THE INVENTION

This invention aims to solve the aforementioned problems, and provide a novel image forming apparatus capable of forming a quality image without color shift or uneven pitch on an output image even when the continuous print operation is performed while various image modes being switched over, thereby achieving higher productivity in continuous printing and a longer lifetime for the imaging section.

As an aspect of the present invention, there is provided an image forming apparatus that includes a first image carrier on which a toner image by black toner is formed; a plurality of second image carriers each on which a toner image by color toner forming a color image is formed; a third image carrier on which a toner image of a special color different from the black toner and the color toner is formed; a transfer target member, disposed opposite each of the first to third image carriers, on which the toner images formed by the first to third image carriers are superimposed; a first detachment unit to detach the third image carrier from the transfer target member; and a second detachment unit to detach the plurality of second image carriers and the third image carrier from the transfer target member. In the image forming apparatus, when switching from a special color image mode to either a normal color image mode or a monochrome image mode is performed during continuous printing of the recording medium, the first detachment unit or the second detachment unit controls the detachment operation based on a number of recording media continuously printed by the normal color image mode or the monochrome image mode. In the special color image mode, the toner images formed respectively on the first image carrier, the plurality of second image carriers, and the third image carrier are totally, superimposedly transferred to the transfer target member; in the normal color image mode, the toner images formed respectively on the first image carrier and the plurality of second image carriers are superimposedly transferred to the transfer target member; and in the monochrome image mode, the toner image formed on the first image carrier only is transferred to the transfer target member.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

Figure 1:
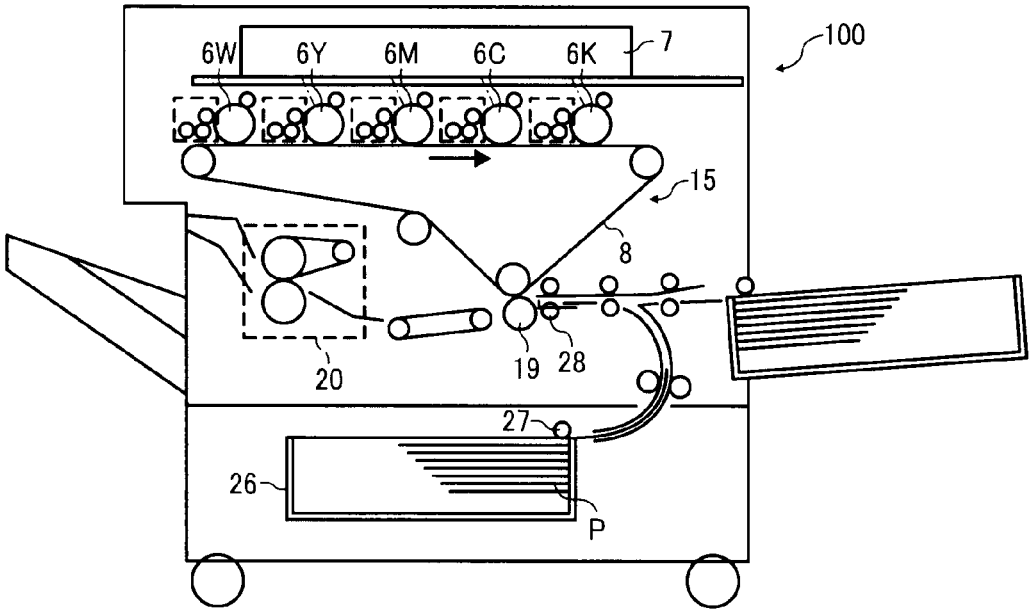
FIG. 1 shows a configuration of an image forming apparatus as an embodiment of the present invention.

Preferred embodiments of the present invention will now be described with reference to the drawings, wherein like reference numerals designate identical or corresponding parts throughout the several views.

First Embodiment

A first embodiment of the present invention will now be described with reference to FIGS. 1 through 11.

First, a configuration and operation of an entire image forming apparatus will be described with reference to FIGS. 1 through 3.

FIG. 1 is a configuration of the image forming apparatus serving as a copier. FIG. 2 is an enlarged view of the image forming section of the apparatus. FIG. 3 shows a diagram showing a portion in the proximity of an intermediate transfer belt 8.

As illustrated in FIG. 1, an intermediate transfer unit 15 or an intermediate transfer belt unit is disposed in the central portion of the main body of the image forming apparatus 100. The intermediate transfer unit 15 includes an intermediate transfer belt 8. An image forming section 6K for black toner, image forming sections 6Y, 6M, and 6C for color toner corresponding to three colors of yellow, magenta, and cyan, and an image forming section 6W for special toner are disposed in parallel and opposite the intermediate transfer belt 8 of the intermediate transfer unit 15. A secondary transfer roller 19 serving as a secondary transfer member is also disposed opposite the intermediate transfer belt 8.

Figure 2:
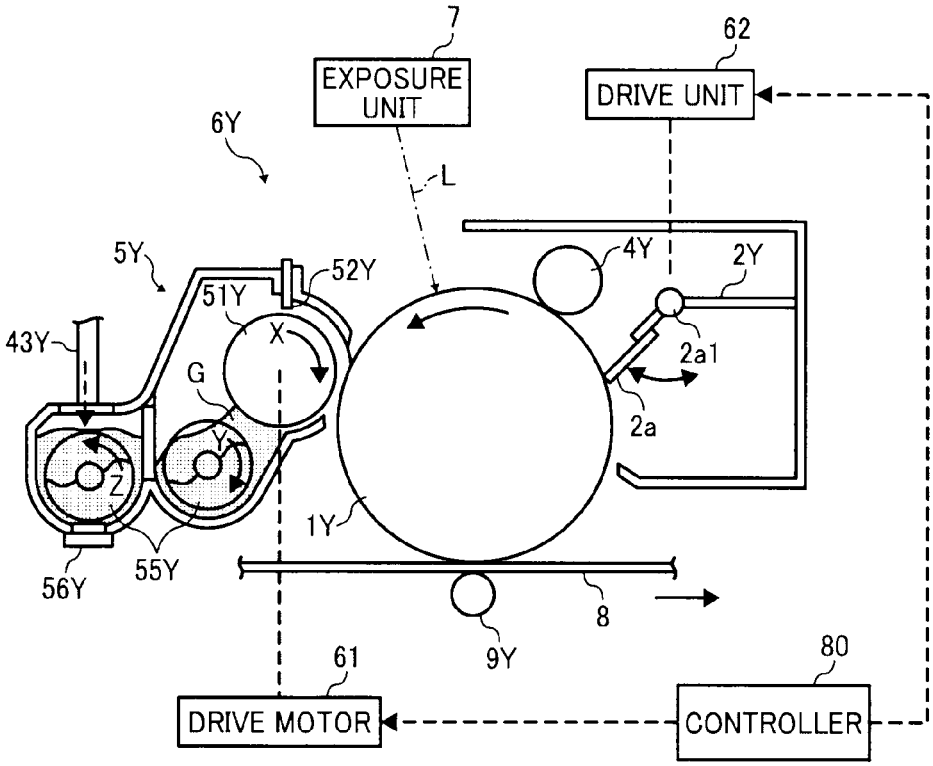
FIG. 2 is a cross-sectional view illustrating an image forming section of the image forming apparatus shown in FIG. 1.

Referring to FIG. 2, the image forming section 6Y for yellow mainly includes: a photoreceptor drum 1Y classified as a second photoreceptor drum to serve as an image carrier classified as a second image carrier; a charger 4Y disposed around the photoreceptor drum 1Y; a developing section 5Y; a cleaning section 2Y; a discharger, and the like. On the photoreceptor drum 1Y, imaging processes from a charging process, exposure process, developing process, transfer process to cleaning process are performed, thereby forming a yellow image on the photoreceptor drum 1Y.

Other four image forming sections 6M, 6C, 6K, and 6W each have the substantially same structure as in the image forming section 6Y except that the color of the toner for use is different, and each forms an image of a corresponding one color of toner. Therefore, a description will be given mainly of the image forming section 6Y.

In the first embodiment, the photoreceptor drum for the image forming section 6K for the black toner is designated a first photoreceptor drum 1K as a first image carrier. Similarly, the plurality of photoreceptor drums for the image forming sections 6Y, 6M, and 6C for the color toner are designated second photoreceptor drums 1Y, 1M, and 1C, respectively, that is, second image carriers. Also, similarly, the photoreceptor drum for the image forming section 6W for the special toner is designated a third photoreceptor drum 1W, that is, a third image carrier. The photoreceptor drums 1Y, 1M, 1C, 1K, and 1W have substantially the same configuration, and either may be called as a photoreceptor drum or image carrier to thus eliminate redundant description of configuration and operation in an individual photoreceptor drum.

The special toner stored in a developing section and toner container to be used in the image forming section 6W is transparent and does not contain a colorant, and is different from the toner used in the image forming sections 6Y, 6M, and 6C for the color toner and the image forming section 6K for the black toner.

Referring to FIG. 2, the photoreceptor drum 1Y as an image carrier is driven to rotate in a counterclockwise direction in FIG. 1 by the main drive motor, not shown. Upon arriving at a position of the charger 4Y, a surface of the photoreceptor drum 1Y is uniformly charged (charging process).

Then, upon arriving at an exposure position of a laser beam L emitted from the exposure unit 7, the surface of the photoreceptor drum 1Y is exposed and scanned, whereby an electrostatic latent image corresponding to the color yellow is formed thereon (exposure process).

Thereafter, upon the surface of the photoreceptor drum 1Y arriving at a position opposite the developing unit 5Y, the electrostatic latent image thereon is developed, thereby forming a yellow toner image (developing process).

Then, arriving at a position opposite the intermediate transfer belt 8 and a transfer roller 9Y serving as a primary transfer roller, the toner image on the photoreceptor drum 1Y is transferred to the intermediate transfer belt 8 as a transfer target member (primary transfer process). In this case, a slight amount of toner which has not been used in the transfer remains on the photoreceptor drum 1Y.

Then, arriving at a position opposite the cleaning section 2Y, the residual toner remaining on the photoreceptor drum 1Y is collected by a cleaning blade 2*a* into the cleaning section 2Y (cleaning process).

Finally, arriving at a position opposite a discharger, not shown, the electrical charge remaining on the photoreceptor drum 1Y is neutralized.

A series of processes to be performed on the photoreceptor drum is then terminated.

The aforementioned image forming processes are performed at each of the other image forming sections 6M, 6C, 6K, and 6W similarly to the case of yellow image forming section 6Y. Specifically, the exposure unit 7 disposed above the image forming section radiates laser beams L based on the image data toward the photoreceptor drums 1M, 1C, 1K, and 1W of each of the image forming sections 6M, 6C, 6K, and 6W. More specifically, the exposure unit 7 radiates, while scanning the laser beams L with a rotatably driven polygonal mirror, the laser beams L from its light source onto the photoreceptor via a plurality of optical elements.

Thereafter, toner images of respective colors formed, via the developing process, on each of the photoreceptor drums are superimposedly transferred on the intermediate transfer belt 8 as a transfer target member (primary transfer). Then, a desired color image is formed on the intermediate transfer belt 8.

Although not shown, the image forming apparatus 100 also includes an original document conveyance section to convey the original document and an image reading section to optically read the image information of the original document, both being disposed above the exposure unit 7.

Here, referring to FIG. 1, the five image forming sections 6Y, 6M, 6K, and 6W are arranged from an upstream side in the conveyance direction of the intermediate transfer belt 8 in an order of the image forming section 6W for the special toner, the image forming section 6Y for the yellow toner, the image forming section 6M for the magenta toner, the image forming section 6C for the cyan toner, and the image forming section 6K for the black toner. Accordingly, after the toner image of the transparent toner (the special toner) formed on the third photoreceptor drum 1W (or the third image carrier) is primarily transferred to the intermediate transfer belt 8, the toner images of the color toner respectively formed on the second photoreceptor drums 1Y, 1M, and 1C (the plurality of second image carriers) and the toner image of the black toner formed on the first photoreceptor drum 1K for the black toner (the first image carrier) are primarily transferred to the intermediate transfer belt 8 superimposedly.

Thereafter, the intermediate transfer belt 8 (the transfer target member) on which toner images of respective colors are superimposedly transferred reaches a contact portion (nip portion) with the secondary transfer roller 19. At the nip portion, the secondary transfer roller 19 and a secondary transfer opposite roller 12B sandwiches the intermediate transfer belt 8, thereby forming a secondary transfer nip portion. Then, a bias voltage having a same polarity as that of the toner is applied to the secondary transfer opposite roller 12B, and a bias voltage having a polarity opposite that of the toner is applied to the secondary transfer roller 19. Thus, the color toner image formed on the intermediate transfer belt 8 is secondarily transferred to the recording medium P such as a transfer sheet conveyed to this secondary transfer nip portion, which is the secondary transfer process. At this time, residual toner not used in the transfer to the recording medium P remains on the intermediate transfer belt 8.

Then, the intermediate transfer belt 8 reaches a position of the intermediate transfer cleaning section 10, in which the unused toner on the intermediate transfer belt 8 is removed.

The series of transfer processes related to the intermediate transfer belt 8 is thus completed.

Referring again to FIG. 1, it is noted that the recording medium P conveyed at the secondary transfer nip portion is conveyed from the sheet feed section 26 disposed at a lower part of the apparatus main body 100, via the sheet feed roller 27 and the registration roller pair 28.

Specifically, the sheet feed section 26 includes a plurality of recording media P such as transfer sheets in a piled manner. Then, when the sheet feed roller 27 is driven to rotate in a counterclockwise direction in FIG. 1, a topmost recording medium P is conveyed toward between the rollers of the registration roller pair 28.

The recording medium P conveyed to the registration roller pair 28 is temporarily halted at a nip portion of the registration roller pair 28 which stops its rotation. Then, in sequence with the color image on the intermediate transfer belt 8, the registration roller pair 28 is driven to rotate and the recording medium P is conveyed toward a secondary transfer nip portion. Finally, a desired color image is transferred onto the recording medium P.

Thereafter, the recording medium P on which the color image is transferred at the secondary nip portion is conveyed to a position of a fixing unit 20. Then, the color image transferred onto the recording medium P is fixed thereon by heat and pressure exerted by a fixing belt and a pressure roller.

The recording medium P is then discharged outside the apparatus by a discharge roller pair, not shown. The recording medium P discharged outside the apparatus by the discharge roller pair is sequentially stacked on a stack section, as an output image.

Thus, a series of image forming processes in the image forming apparatus is completed.

Next, referring back to FIG. 2, a configuration and operation of the image forming section will be described more in detail.

The developing section 5Y includes a developing roller 51Y disposed opposite the photoreceptor drum 1Y; a doctor blade 52Y disposed opposite the developing roller 51Y; two conveyance screws 55Y disposed inside a developer container; a toner supply path 43Y communicating with the developer container via an opening; a magnetic sensor 56Y to detect toner density of the developer, and the like. The developing roller 51Y includes a magnet fixedly disposed therein; a sleeve to rotate around the magnet; and the like. Inside the developer container, two-component developer formed of toner and carrier is stored.

The toner supply path 43Y is used to supply new toner as needed from a toner container storing new toner, not shown, toward the developing section 5Y. The new toner is supplied to the developing section 5Y so that a toner density, that is, a ratio of toner in the entire developer, is kept within a predetermined range.

The thus-configured developing section 5Y operates as follows.

The sleeve of the developing roller 51Y rotates in the direction of arrow X in FIG. 2. The developer carried on the developing roller 51Y by the electric field moves along the developing roller 51Y due to the rotation of the sleeve.

Then, the toner supplied to the developer container, while being mixed and agitated with the developer by the two conveyance screws 55Y each rotating in opposite directions as indicated by arrows Y and Z, flows between the two developer containers divided each other (in a direction perpendicular to the surface of the figure). Then, the toner in the developer is attracted to the carrier by friction charging with the carrier, and is carried on the developing roller 51Y together with the carrier by the magnetic force created on the developing roller 51Y.

The developer carried on the developing roller 51Y is conveyed toward the arrow direction in FIG. 2 and reaches a position where the doctor blade 52Y is disposed. Then, the amount of the developer on the developing roller 51Y is adjusted there, and the developer is conveyed to a position opposite the photoreceptor drum 1Y, that is, a developing area. Due to the electric field formed in the developing area, toner is attached to the latent image formed on the photoreceptor drum 1Y by an electric field created on the developing field. The developer remaining on the developing roller 51Y, upon arriving at a portion above the developer container accompanied by the rotation of the sleeve, is separated from the developing roller 51Y.

The developing roller 51Y and the conveyance screws 55Y are driven to rotate by a drive motor 61. Specifically, the drive motor 61 transmits a driving force to a shaft or sleeve of the developing roller 51Y, and the driving force transmitted to the developing roller 51Y is further transmitted to the two conveyance screws 55Y via gear trains. Herein, the drive motor 61 to drive the developing section 5Y is provided separately from the main drive motor, not shown, to drive to rotate other rotary members such as the photoreceptor drum 1Y so that a controller 80 can control the developing section 5Y to be driven or stopped independently.

The cleaning blade 2*a* contacting the photoreceptor drum 1Y is so configured as to rotate freely in a double-headed arrow direction in FIG. 2 about a rotation shaft 2*a*1 by a drive section 62 controlled by a controller 80. That is, the cleaning blade 2*a* freely attaches to and detaches from the photoreceptor drum 1Y.

Figure 3:
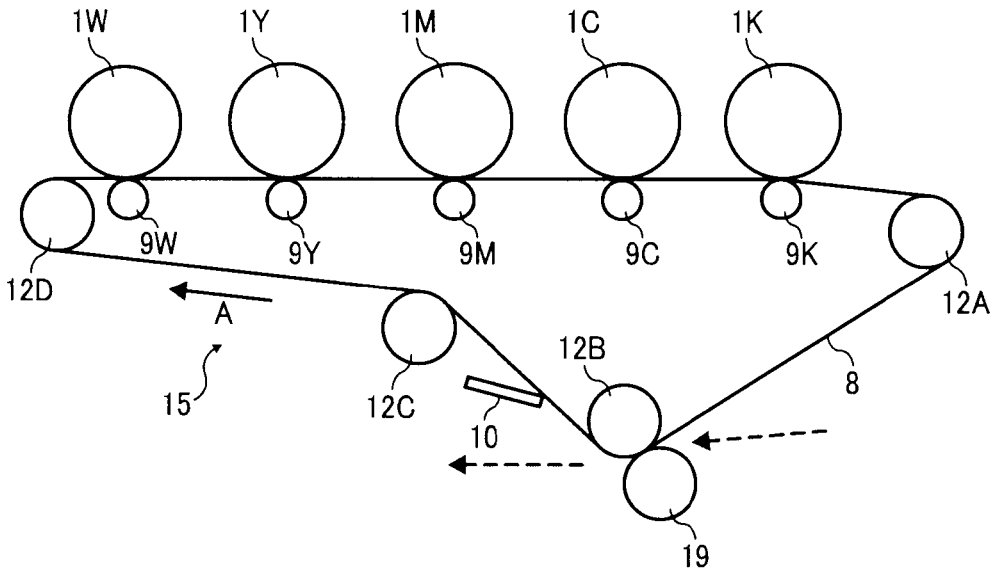
FIG. 3 is a schematic diagram illustrating a portion around an intermediate transfer belt.

FIG. 3 is a diagram of the intermediate transfer unit 15. Referring to FIG. 3, the intermediate transfer unit 15 or intermediate transfer belt unit will be described in detail.

As illustrated in FIG. 3, the intermediate transfer unit 15 includes an intermediate transfer belt 8 as a transfer target member; the five primary transfer rollers 9Y, 9M, 9C, 9K, and 9W; a drive roller 12A; the secondary transfer opposite roller 12B; a tension roller 12C; a correction roller 12D; an intermediate transfer cleaning unit 10; and the like. The intermediate transfer belt 8 is stretched over and supported by the plurality of rollers 12A to 12D, and is driven to rotate in the direction indicated by arrow A in FIG. 3 by the rotation of the drive roller 12A.

The first photoreceptor drum 1K for the black toner (the first image carrier) on which a toner image by the black toner is formed, the second photoreceptor drums 1Y, 1M, and 1C (the plurality of second image carriers) each on which a toner image by the color toner (yellow, magenta, and cyan) is formed, and the third photoreceptor drum 1W (the third image carrier) on which a toner image of the special toner is formed are disposed opposite and contacting the intermediate transfer belt 8 being a transfer target member.

The intermediate transfer belt 8 is sandwiched in between the five primary transfer rollers 9Y, 9M, 9C, 9K, and 9W and the corresponding photoreceptor drums 1Y, 1M, 1C, 1K, and 1M, to form a primary transfer nip, respectively. Then, a transfer bias voltage having a polarity opposite the polarity of the toner is applied to the primary transfer rollers 9Y, 9M, 9C, 9K, and 9W.

Then, upon running toward the arrow direction in FIG. 3, the intermediate transfer belt 8 sequentially passes through the primary transfer nip of the primary transfer rollers 9Y, 9M, 9C, 9K, and 9W, whereby toner images of respective colors on the photoreceptor drums 1Y, 1M, 1C, 1K, and 1W are primarily and superimposedly transferred on the intermediate transfer belt 8, sequentially in an order of a transparent toner image, a yellow toner image, a magenta toner image, a cyan toner image, and a black toner image.

Thus, by using a transparent toner or a special toner, compared to the normal full-color image output by the normal color image mode using four colors including yellow, magenta, cyan, and black only, glossiness of the image may be controlled easily and the transfer rate of the four-color toner image is improved. Further, printing of special patterns such as watermarks and background marks is allowed, and the output image may have a concave and convex surface.

In the present first embodiment, the intermediate transfer belt 8 as an intermediate transfer member is formed of a single or multiple layers using polyimide (PI), polyvinylidene fluoride (PVDF), ethylene tetrafluoroethylene (ETFE), polycarbonate (PC), and the like, and conductive materials such as carbon black and the like dispersed therein, with a volume resistivity adjusted to be in a range from $10^7$ to $10^{12}$ Ωcm and a thickness of 80 to 100 μm.

If necessary, a release layer may be additionally coated on the top of the intermediate transfer belt 8. The release layer may use fluorine resins such as ethylene tetrafluoroethylene copolymer (ETFE), polytetrafluoroethylene (PTFE), polyvinylidene fluoride (PVDF), perfluoroalkoxy (PEA), tetrafluoroethylene-hexafluoropropylene copolymer (FEP), polyvinylfluoride (PVF), and the like, but not limited thereto.

The intermediate transfer belt 8 may be manufactured by molding, centrifugal molding, and the like. If necessary, the surface of the belt may be polished.

The drive roller 12A is driven to rotate by a motor, not shown. With this configuration, the intermediate transfer belt 8 is allowed to run in the predetermined clockwise conveyance direction as illustrated in FIG. 3.

One end of the correction roller 12D is fixed and another end thereof is configured to move vertically so that the rotation axis is inclined, based on the displacement amount of the intermediate transfer belt 8 detected by a wobbling detection sensor, not shown. With this configuration, shifting or wobbling of the intermediate transfer belt 8 in the width direction is corrected.

The tension roller 12C contacts an outer circumference of the intermediate transfer belt 8. Between the secondary transfer opposite roller 12B and the tension roller 12C, the intermediate transfer cleaning unit 10 including the cleaning blade is disposed.

The secondary transfer opposite roller 12B contacts the secondary transfer roller 19 or the secondary transfer member, via the intermediate transfer belt 8 as a transfer target member. The secondary transfer opposite roller 12B is formed of a metal core and a medium-resistant rubber layer formed on the metal core, and is configured to have resistance of $10^7$ to $10^{8.5}$Ω under environmental conditions of 23° C. with relative humidity of 50%.

The secondary transfer roller 19 as a secondary transfer member includes a metal core and a conductive rubber layer formed of nitrile rubber (NBR), for example, which is formed on the metal core. The conductive rubber layer has stiffness of 48 to 58 Hs.

In the present first embodiment, the secondary transfer roller is used as a secondary transfer member to perform the secondary transfer process; however, a known secondary transfer member using corona discharging may be used as a secondary transfer member.

The configuration and operation of the first embodiment of the present invention will now be described.

With reference to FIGS. 4 to 7, the intermediate transfer unit 15 of the first embodiment includes a first attach-detach unit 71 to attach or detach the first photoreceptor drum 1K relative to the intermediate transfer belt 8, the second attach-detach unit 72 to attach or detach the plurality of second photoreceptor drums 1Y, 1M, and 1C relative to the intermediate transfer belt 8, and the third attach-detach unit 73 to attach or detach the third photoreceptor drum 1W relative to the intermediate transfer belt 8.

The first attach-detach unit 71 includes an oscillation arm 71*a* rotatably supporting the primary transfer roller 9K for black; an eccentric cam 71*b* contacting the oscillation arm 71*a;* a stepping motor, not shown, to rotatably drive the eccentric cam 71*b*, and the like. A support axis 71*a*1 of the oscillation arm 71*a* is rotatably supported by a side plate of the intermediate transfer unit 15. The stepping motor, controlled by the controller, drives to rotate the eccentric cam 71*b* by a predetermined angle, thereby rotating the oscillation arm 71*a* in such a direction that the primary transfer roller 9K for black attaches to or detaches from the first photoreceptor drum 1K (see a transition from FIGS. 4, 5, and 6 to FIG. 7 and vice versa). Thus, the first photoreceptor drum 1K performs attach-detach operation relative to the intermediate transfer belt 8.

Similarly, the second attach-detach unit 72 includes an oscillation arm 72*a* rotatably supporting three primary transfer rollers 9Y, 9M, and 9C for the colors Y, M, and C; an eccentric cam 72*b* contacting the oscillation arm 72*a;* a stepping motor, not shown, to rotatably drive the eccentric cam 72*b*, and the like. A support axis 72*a*1 of the oscillation arm 72*a* is rotatably supported by the oscillation arm 71*a* for the black image formation. The stepping motor, controlled by the controller, drives to rotate the eccentric cam 72*b* by a predetermined angle, thereby rotating the oscillation arm 72*a* in such a direction that the primary transfer rollers 9Y, 9M, and 9C for the colors Y, M, and C attach to or detach from the second photoreceptor drums 1Y, 1M, and 1C (see a transition from FIGS. 4 and 5 to FIG. 6 and vice versa). Thus, the first photoreceptor drum 1K performs attach-detach operation relative to the intermediate transfer belt 8. Thus, the second photoreceptor drums 1Y, 1M, and 1C perform attach-detach operation relative to the intermediate transfer belt 8.

Then, the third attach-detach unit 73 serves to detach only the third photoreceptor drum 1W from the intermediate transfer belt 8 as a first detachment means. Specifically, the third attach-detach unit 73 transits from a state in FIG. 4 to another in FIG. 5, whereby only the third photoreceptor drum 1W is separated from the intermediate transfer belt 8 and the other four photoreceptor drums 1Y, 1M, 1C, and 1K come in contact with the intermediate transfer belt 8.

Further, the second attach-detach unit 72 and the third attach-detach unit 73 jointly serve to detach the second and third photoreceptor drums Y, 1M, 1C and 1W relative to the intermediate transfer belt 8 as a second detachment means. Specifically, the third attach-detach unit 73 transits from a state in FIG. 5 to another in FIG. 6 as well as the second attach-detach unit 72 transits from a state in FIG. 5 to another in FIG. 6, whereby the second and third photoreceptor drums 1Y, 1M, 1C, and 1W are separated from the intermediate transfer belt 8, and only the first photoreceptor drum 1K comes in contact with the intermediate transfer belt 8.

In a state in which three attach-detach units 71 to 73 are so controlled that all photoreceptor drums 1Y, 1M, 1C, 1K and 1W contact the intermediate transfer belt 8 (a state in FIG. 4), image forming processes using five colors of toner (yellow, magenta, cyan, black, and transparent color) are performed as aforementioned referring to FIGS. 1 through 3, which is referred to as a special color image mode. Such a special color image mode can be automatically selected when the original document set on the automatic document feeder, not shown, of the image forming apparatus body 100 is optically sensed or manually selected by a user to operate on the display panel, not shown. Specifically, when it is determined that a special pattern to be printed or an output image needs to have a concave-convex surface from the original document set on the apparatus body 100, the special color image mode is automatically or manually selected.

Figure 5:
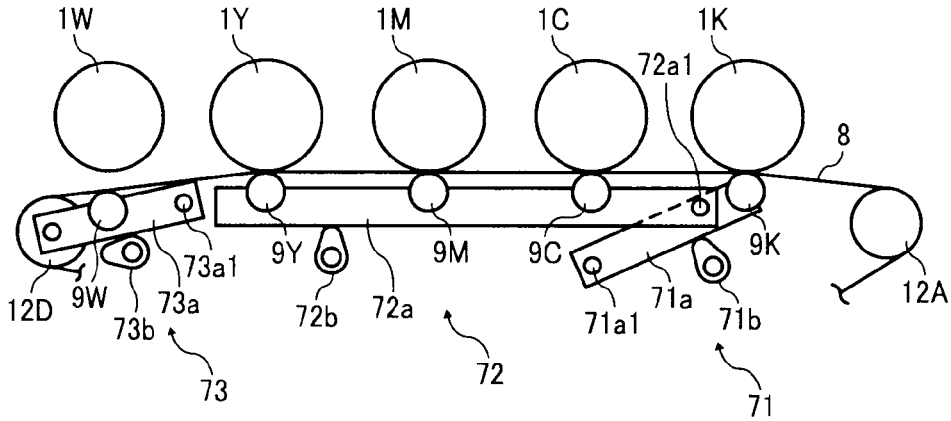
FIG. 5 is a diagram showing a state in which the third photoreceptor drum is separated from the intermediate transfer belt.

By contrast, in a state as illustrated in FIG. 5 in which the third photoreceptor drum 1W is separated from the intermediate transfer belt 8 and the other four photoreceptor drums 1Y, 1M, 1C, 1K come in contact with the belt 8 during print operation of one copy, image forming processes using four colors Y, M, C, and K of toner (a normal color image mode) are performed. Such a normal color image mode is also automatically selected when the original document set on the automatic document feeder, not shown, of the image forming apparatus body 100 is optically sensed, or manually selected by a user to operate on the display panel, not shown. Specifically, when it is determined that image formation using the special toner is not necessary and the ordinary full-color image formation using four colors of toner is appropriate from the original document set on the apparatus body 100, the normal color image mode is automatically or manually selected.

Figure 6:
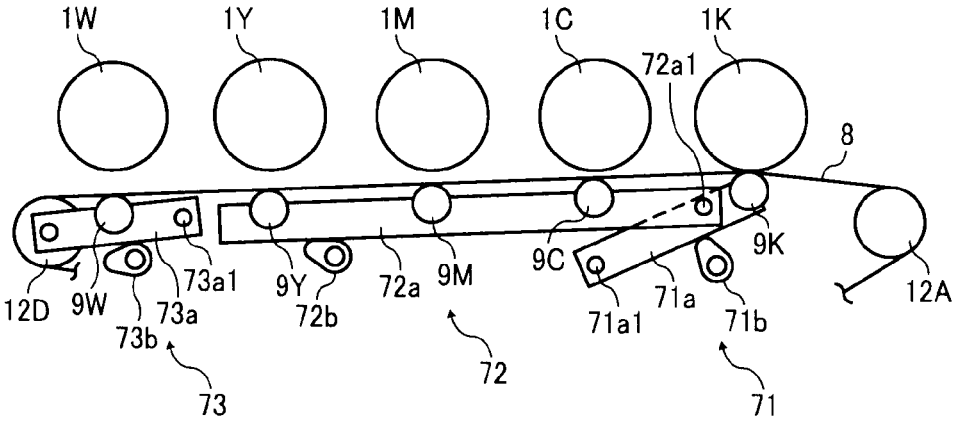
FIG. 6 is a diagram showing a state in which only the first photoreceptor drum contacts the intermediate transfer belt.

Further, in a state as illustrated in FIG. 6 in which only the first photoreceptor drum 1K contacts the intermediate transfer belt 8 and the other four photoreceptor drums 1Y, 1M, 1C, and 1W are separated from the belt 8 during print operation of one copy, image forming processes using only the black toner (a monochrome image mode) are performed. Such a monochrome image mode is also automatically selected when the original document set on the automatic document feeder, not shown, of the image forming apparatus body 100 is optically sensed, or manually selected by a user to operate on the display panel, not shown. Specifically, when it is determined that image formation using the special toner and four colors (Y, M, C, and K) of toner is not necessary and the black and white image formation using only the black toner is appropriate from the original document set on the apparatus body 100, the monochrome image mode is automatically or manually selected.

As described above, by detaching unnecessary photoreceptor drum(s) from the intermediate transfer belt 8 depending on the selected image mode, degradation produced by friction between the unnecessary photoreceptor drum and the intermediate transfer belt 8 can be reduced, and a longer lifetime of each of the photoreceptor drums and intermediate transfer belt 8 can be attained.

Moreover, in the preferred first embodiment of the present invention, when no image forming operation is performed in the image forming apparatus 100 such as in a standby time or at a time of completion of the print operation, all five photoreceptor drums are so controlled via the three attach-detach units 71 through 73 as to be detached from the intermediate transfer belt 8. Accordingly, a longer lifetime for each of the photoreceptor drums 1Y, 1M, 1C, 1K, and 1W, the corresponding image forming sections 96Y, 6M, 6C, 6K, and 6W, and the intermediate transfer belt 8 is secured.

Here, the image forming apparatus according to the preferred first embodiment of the present invention can perform print operation automatically by switching between various image modes in one print job while continuously performing printing on the recording medium P in a case where a plurality of original copies (or image information) are set on the automatic document feeder or output.

Specifically, when various original copies are mixedly present, an optimum image mode between the special color image mode, normal color image mode, and monochrome image mode is automatically selected for each original document.

In the special color image mode or five-color mode, the toner image formed on the first photoreceptor drum 1K, the toner images respectively formed on the second photoreceptor drums 1Y, 1M, and 1C, and the toner image formed on the third photoreceptor drum 1W are all superimposedly transferred onto the intermediate transfer belt 8. In the normal color image mode or four-color mode, the toner image formed on the first photoreceptor drum 1K and the toner images respectively formed on the second photoreceptor drums 1Y, 1M, and 1C are superimposedly transferred onto the intermediate transfer belt 8. In the monochrome image mode or black and white mode, only the toner image formed on the first photoreceptor drum 1K is transferred onto the intermediate transfer belt 8.

In the first embodiment of the present invention, during continuous print operation to the recording medium P, when the special color image mode is switched to the normal color image mode, the third attach-detach unit 73 controls the detachment operation based on a continuous print number of the recording media P by the normal color image mode. Specifically, in a case in which a continuous print operation of the recording media P is performed, when the special color image mode is switched to the normal color image mode, after the number of recording media P to be continuously conveyed by the normal color image mode has reached a predetermined threshold value n, the third attach-detach unit 73 is controlled to perform detachment operation. In other words, in a case in which there are a plurality of types of original copies to be automatically and sequentially conveyed and read out in one print job, when the original copies or image information for the special color image mode are switched to the original copies or image information for the normal color image mode, the third attach-detach unit 73 is controlled to perform detachment operation after the number of recording media P to be image-formed by the normal color image mode has reached a predetermined threshold value n.

Specifically, switching from the special color image mode to the normal color image mode has been executed, and until the number of recording media P to be continuously printed by the normal color image mode reaches a predetermined threshold value n, the detachment operation of the third contact-detach unit 73 is not performed. And with all five photoreceptor drums 1Y, 1M, 1C, 1K, and 1W in contact with the intermediate transfer belt 8, image formation by four colors Y, M, C, and K by the normal color image mode is performed. After the number of recording media P continuously printed by the normal color image mode reaches a predetermined threshold value n, the detachment operation by the third attach-detach unit 73 is swiftly performed and image formation by four colors Y, M, C, and K by the normal color image mode is performed with the four photoreceptor drums 1Y, 1M, 1C, and 1K contacted with the intermediate transfer belt 8. Meanwhile, when printing by the normal color image mode is performed with all five photoreceptor drums 1Y, 1M, 1C, 1K, and 1W contacted with the intermediate transfer belt 8, image formation at the image forming section 6W for the special toner is not performed, and the primary transfer roller 9W for the special toner is applied with reverse voltage so as to prevent toner deposition from the third photoreceptor drum 1W to the intermediate transfer belt 8.

As controlled as above, even when the continuous printing is performed by switching the image forming mode between various modes, abnormal images including color shift and uneven pitches can be prevented, and a longer lifetime of the image forming section 6W can be achieved while preventing reduction in the productivity in the continuous printing to a certain degree. Specific effects of the present embodiment will be described later with reference to FIGS. 9 and 10.

The aforementioned "predetermined threshold value n" can be set manually on the operation panel, not shown, of the apparatus body 100, whereby the image forming apparatus according to the present embodiment can handle needs of a type of user who intends to prioritize a longer lifetime of the image forming section rather than the productivity in the continuous printing and another who prioritizes the productivity in the continuous printing rather than the longer lifetime of the image forming section.

Hereinafter, a specific control sequence in the continuous printing will now be described.

First, in the continuous printing, in a case in which image forming is performed by the special color image mode (in step S1), whether a next copy (or image information) is imaged by the normal color image mode or not is determined (in step S2). As a result, if it is determined that the next copy (or image information) is not imaged by the normal color image mode, print operation by the special color image mode is continued.

By contrast, in step S2, if it is determined that the next copy (or image information) is imaged by the normal color image mode, it is further determined whether the threshold value n is set to be 1 (one) (in step S3).

As a result, if it is determined that the threshold value n is set to be 1, detachment operation of the third photoreceptor drum 1W is performed by the third attach-detach unit 73 (in step S4), and print operation is performed by the normal color image mode in a state as illustrated in FIG. 5 in which the third photoreceptor drum 1W detaches from the intermediate transfer belt 8 and the other four photoreceptor drums 1Y, 1M, 1C, 1K come in contact with the intermediate transfer belt 8 (in step S5).

Figure 4:
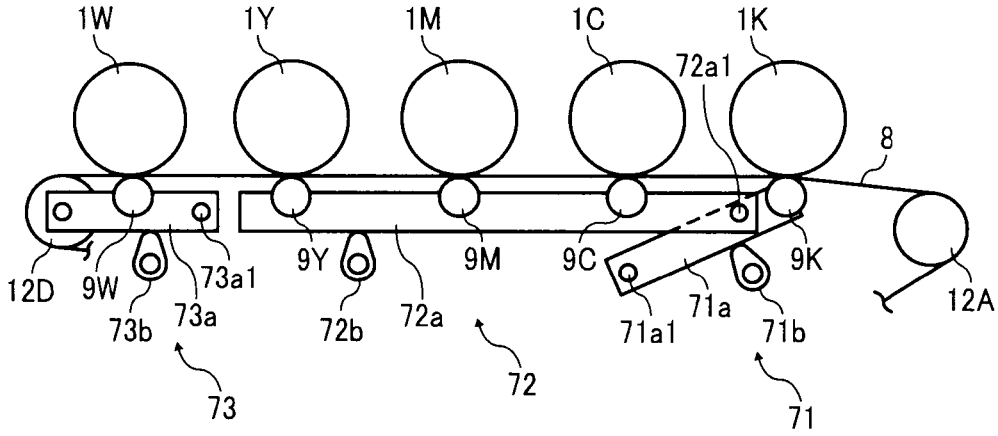
FIG. 4 is a schematic diagram illustrating an attach-detach mechanism of the intermediate transfer belt.

By contrast, if in step S3, it is determined that the threshold value n is not set to be 1, the detachment operation of the third photoreceptor drum 1W by the third attach-detach unit 73 is not performed, and printing operation by the normal color image mode is performed by the normal color image mode in a state as illustrated in FIG. 4 in which the five photoreceptor drums 1Y, 1M, 1C, 1K, and 1W come in contact with the intermediate transfer belt 8 (in step S6). Subsequently, it is determined whether or not printing of (n−1) number of copies for the normal color image mode has continued (in step S7), and after it is determined that printing of (n−1) copies for the normal color image mode has continued, the third attach-detach unit 73 detaches the third photoreceptor drum 1W from the intermediate transfer belt 8 (in step S4). In the state as illustrated in FIG. 5 in which the third photoreceptor drum 1W detaches from the intermediate transfer belt 8, printing operation by the normal color image mode is performed (in step S5).

In the above control sequence, when the threshold value n is set to zero, printing operation by the normal color image mode is performed in the state as illustrated in FIG. 4 in which five photoreceptor drums 1Y, 1M, 1C, 1K, and 1W always come in contact with the intermediate transfer belt 8, even though there is an original document for the normal color image mode during continuous printing.

Figure 8:
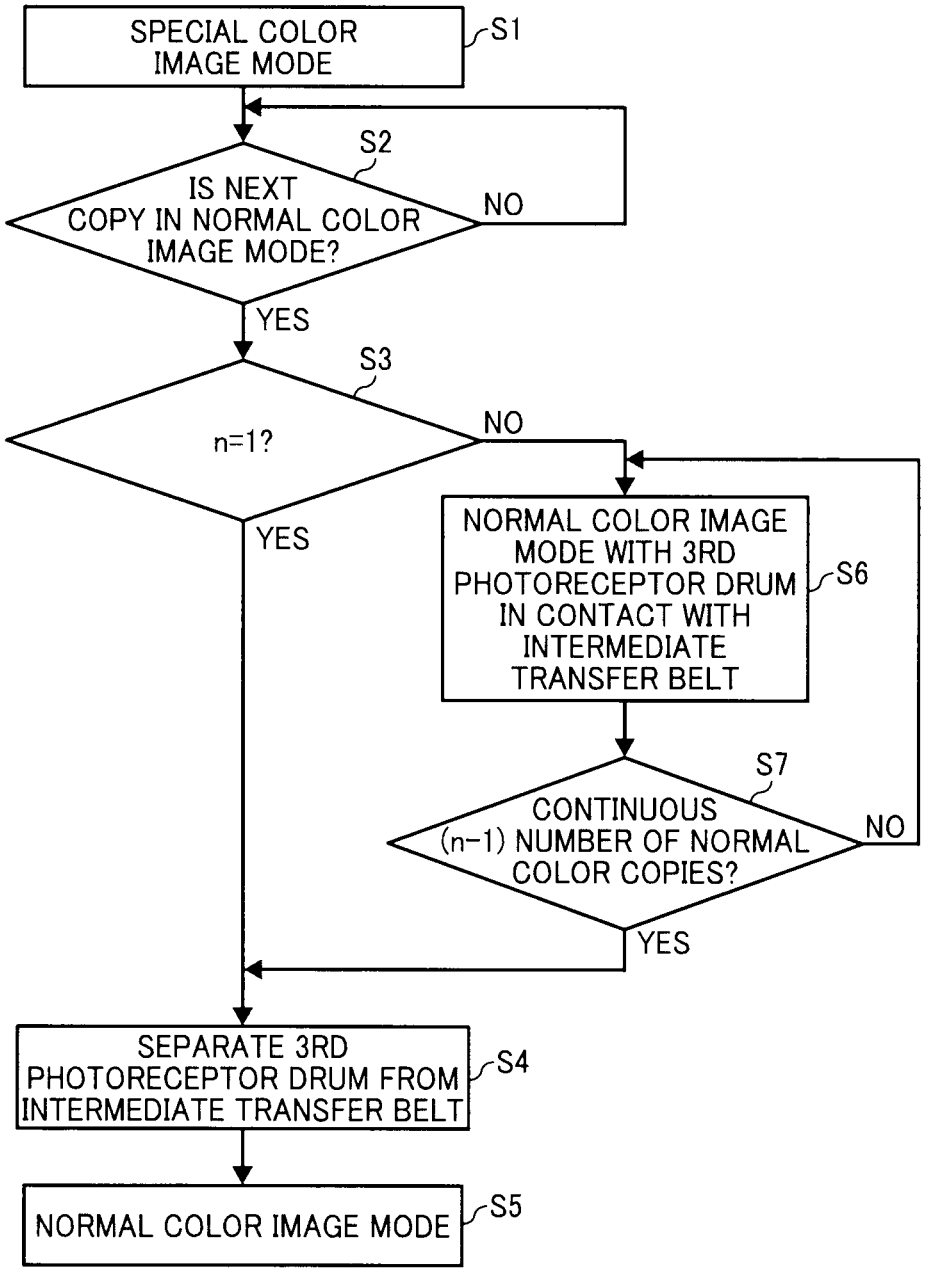
FIG. 8 is a flowchart showing a control during the continuous print operation.
Figure 9:
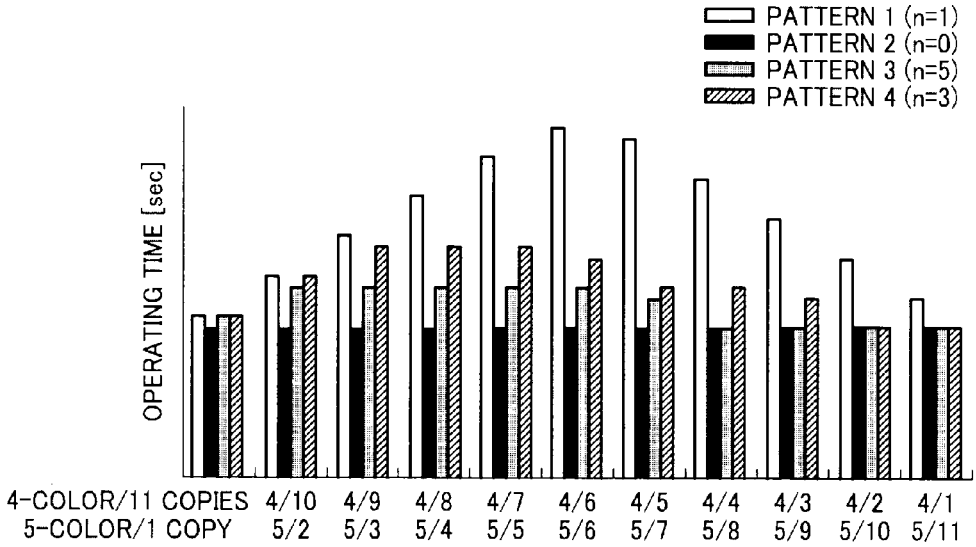
FIG. 9 is a graph showing operating time of the image forming apparatus when normal color copies and special color copies mixedly exist.

FIG. 9 is a graph showing operating time of the image forming apparatus 100 when 12 (twelve) mixed original copies including normal color copies (i.e., four-color copies) and special color copies (i.e., five-color copies) are set in the original document feed section in a case in which the control as illustrated in FIG. 8 was performed.

In FIG. 9, a horizontal axis shows respective numbers of sheets of the normal color copies (indicated as 4-color) and the special color copies (indicated as 5-color) between 12 sheets of original copies. A vertical axis shows the operating time of the image forming apparatus 100 required from starting continuous printing of the 12 copies until the end of the printing. In FIG. 9, a bar corresponding to a pattern 1 shows a case in which the threshold value n is set to be 1 (one) and corresponds to a control in which, upon the 4-color copy coming after the 5-color copy, the third photoreceptor drum 1W is controlled to be detached from the intermediate transfer belt 8. A bar corresponding to a pattern 2 shows a case in which the threshold value n is set to be 0 (zero) and corresponds to a control in which printing is performed by the normal color image mode in the state as illustrated in FIG. 4 in which the third photoreceptor drum 1W is not detached from the intermediate transfer belt 8. A bar corresponding to a pattern 3 shows a case in which the threshold value is set to be 5 (five) and corresponds to a control in which the third photoreceptor drum 1W is controlled to be detached from the intermediate transfer belt 8 when a fifth 4-color original document comes after four 4-color copies are consecutively printed. A bar corresponding to a pattern 4 shows a case in which the threshold value is set to be 3 (three) and corresponds to a control in which the third photoreceptor drum 1W is controlled to be detached from the intermediate transfer belt 8 when a fourth 4-color original document comes after three 4-color copies are consecutively printed.

From an experimental result as illustrated in FIG. 9, it can be seen that the control of the pattern 1 (n=1) takes a considerably longer operating time as a whole compared to other patterns 2 to 4. In particular, when the number of 4-color copies is large and therefore the detachment operation of the third photoreceptor drum 1W is frequent, the time to be taken for the printing operation becomes long. In addition, in the pattern 2 (n=0) in which the detachment operation of the third photoreceptor drum 1W is not performed, the operating time is constant without depending on the type of the copy. From the results related to the pattern 3 (n=5) and the pattern 4 (n=3), if the threshold value is increased, the operating time approaches to that of the pattern 2 (n=0). Specifically, the operating time of the pattern 3 (n=5) is very close to that of the pattern 2 (n=0).

Figure 10:
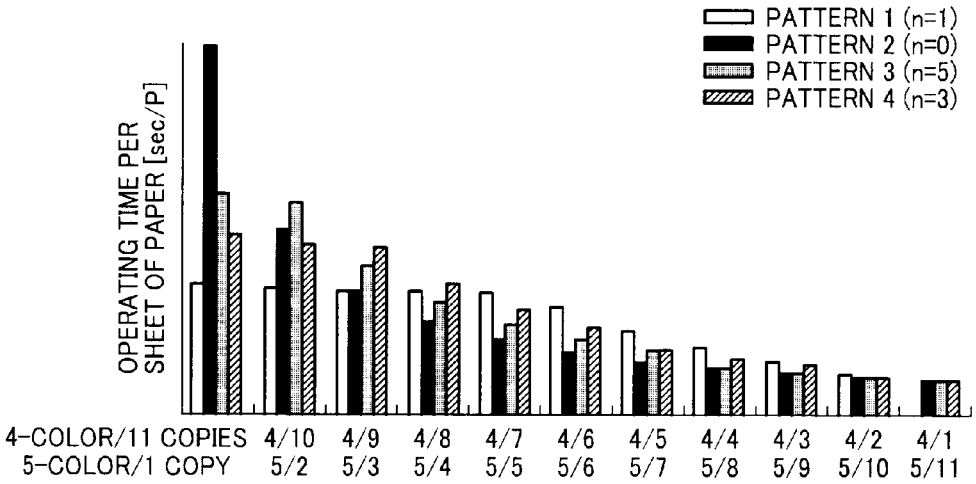
FIG. 10 is a graph showing operating time of the third photoreceptor drum for printing each sheet of recording media when normal color copies and special color copies mixedly exist.

FIG. 10 shows, in the control as illustrated in FIG. 8, operating time of the third photoreceptor drum 1W for printing each sheet of recording media when 12 mixed original copies including normal color copies (four-color copies) and special color copies (five-color copies) are set in the original document feed section.

In FIG. 10, the horizontal axis corresponds to the description as to FIG. 9 and the vertical axis shows operating time of the third photoreceptor drum 1W for printing each sheet of the recording media (obtained by division of 12 on the basis of the total operating time). The patterns 1 through 4 are same and correspond to the description as to FIG. 9. The vertical axis of FIG. 9 shows operating time per each sheet and, although the time changes depending on the combination of the set of original copies, an average operating time is taken for every combination thereof.

From an experimental result as shown in FIG. 10, it can be seen that the operating time of the third photoreceptor drum 1W in the pattern 2 (n=1) in general is considerably longer than the other patterns 1, 3, and 4. This is because the third photoreceptor drum 1W is not detached from the intermediate transfer belt 8 but is driven or idled even during printing by the normal color image mode. By contrast, in the pattern 1 (n=1), because the detachment operation of the third photoreceptor drum 1W is performed without exception in the normal color image mode and the operation thereof is stopped, operating time per sheet of the third photoreceptor drum 1W is shortened. In addition, the operating time in the case of the pattern 3 (n=5) or the pattern 4 (n=3) are longer than the case of the pattern 1 (n=1); however, such an adverse effect that the operating time drastically decreases as in the case of the pattern 2 (n=0) does not occur. Due to the type of combination of the original copies, the operating time for the pattern 3 (n=5) or the pattern 4 (n=3) is elongated compared to the case of the pattern 2 (n=0). This is because it takes time in the detachment operation of the third photoreceptor drum 1W and stoppage and start operation of the image forming section 6W.

Thus, as illustrated in FIGS. 9 and 10, the operating time of the image forming apparatus 100 is shortened by setting the threshold value n to a natural number other than 1 (one) compared to the case of the pattern 1 (n=1) in which the third photoreceptor drum 1W is detached each time when the printing by the normal color image mode is performed after the special color image mode. Also, the operating time per sheet of the image forming section 6W for the special toner is shortened compared to the case of the pattern 2 (n=0) in which the detachment operation of the third photoreceptor drum 1W is not performed. When the special color image mode is switched to the normal color image mode during continuous printing, whether the third photoreceptor drum 1W is detached from the intermediate transfer belt 8 or not is selected based on the number of the recording media continuously printed by the normal color image mode. Then, with such a configuration, without reducing the productivity of the output image, the lifetime of the image forming section 6W for the fifth color can be extended.

In the control as described above, during the continuous printing of the recording media P, when the special color image mode is switched to the normal color mode and the detachment operation of the third photoreceptor drum 1W by the third attach-detach unit 73 (the first detachment unit) is not performed, it is preferred that the developing section of the image forming section 6W for the special toner (corresponding to the developing section 5Y in FIG. 2) be stopped driving. Specifically, in step S6 as illustrated in FIG. 8, the drive motor 61 to drive the developing section in the image forming section 6W for the special toner is stopped. It is noted that the main drive motor to rotatably drive the third photoreceptor drum 1W is operated.

With this configuration, parts and components (such as developing rollers and conveyance screws) in the developing section for the special toner and the developer contained in the developing section are prevented from being degraded.

When the driving of the developing section for the special toner is stopped, it is preferred that a cleaning blade (corresponding to the cleaning blade 2*a* in FIG. 2) of the image forming section 6W for the special toner be detached from the third photoreceptor drum 1W. Specifically, in step S6 as illustrated in FIG. 8, the drive section 62 is controlled to detach the cleaning blade 2*a* in the image forming section 6W for the special toner from the third photoreceptor drum 1W.

According to the above control, any adverse effect to cause the cleaning blade 2*a* to be raised or damaged due to the increase in the sliding resistance between the third photoreceptor drum 1W and the cleaning blade 2*a* resulting from the driving in a state in which the developing section is stopped driving and then the toner is not supplied from the developing section to the rotating third photoreceptor drum 1W, may be prevented.

Further, in the present first embodiment, when the special color image mode is switched to the monochrome image mode during the continuous printing of the recording media, the detachment operation by the second attach-detach unit 72 and the third attach-detach unit 73 is controlled based on the number of recording media P continuously printed by the monochrome image mode. Specifically, in a state in which the continuous printing of the recording media P is being performed and switching of the mode from the special color image mode to the monochrome image mode is performed, after the number of recording media P to be continuously printed by the monochrome image mode has reached a predetermined threshold value n, detachment operation by the third attach-detach unit 73 and the second attach-detach unit 72 is performed. In other words, when the plurality of original copies are sequentially automatically conveyed and read in one print job and switching from the original copies or image information for the special color image mode to the original copies or image information for the monochrome image mode is performed, after the number of recording media P to be image-formed by the monochrome image mode has reached a predetermined threshold value n, detachment operation by the third attach-detach unit 73 and the second attach-detach unit 72 (the second detachment means in combination) is performed.

Specifically, until when the switching from the special color image mode to the monochrome image mode is performed and the number of recording media P continuously printed by the monochrome image mode reaches a predetermined threshold value n, detachment operation by the third attach-detach unit 73 and the second attach-detach unit 72 is not performed and image formation by the black toner (that is, the monochrome image mode) is performed, with all five photoreceptor drums 1Y, 1M, 1C, 1K, and 1W contacting the intermediate transfer belt 8. Then, upon the number of recording media P continuously printed by the monochrome image mode reaching a predetermined threshold value n, detachment operation by the third attach-detach unit 73 and the second attach-detach unit 72 (is performed and image formation with the black toner by the monochrome image mode is performed, with only the first photoreceptor drum 1K contacting the intermediate transfer belt 8. When the continuous printing is performed by the monochrome image mode with all five photoreceptor drums 1Y, 1M, 1C, 1K, and 1W contacting the intermediate transfer belt 8, image formation at the image sections 6Y, 6M, 6C, and 6W other than the image section 6K for the black toner is not performed, and a reverse voltage is applied to corresponding primary transfer rollers 9Y, 9M, 9C, and 9W so that toner adhesion from the second photoreceptor drums 1Y, 1M, and 1C and the third photoreceptor drum 1W to the intermediate transfer belt 8 is not performed.

With such a control, even when the various mixed original copies are continuously printed while switching between the various image modes, abnormal images including color shift or uneven pitches is prevented from occurring in the output images. Further, while preventing decrease in the productivity of the continuous printing to a certain degree, longer lifetime of the image forming sections 6Y, 6M, 6C, and 6W may be attained.

Figure 7:
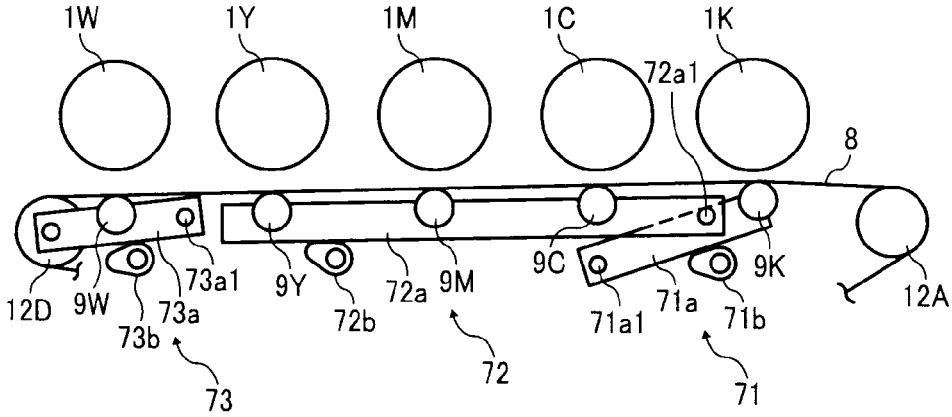
FIG. 7 is a diagram showing a state in which all the photoreceptor drums are separated from the intermediate transfer belt.

In the present first embodiment, the control as described above may be realized together with the control as described with reference to FIG. 7.

Here, the predetermined threshold value n can be set variably to zero or an arbitrary natural number manually using the display panel, not shown, provided on the apparatus body 100, whereby the image forming apparatus according to the present first embodiment can cope with the needs of various users widely from a type of the user who prioritizes a longer lifetime of the image forming section rather than the productivity in the continuous printing to another type of the user who prioritizes the productivity in the continuous printing rather than the longer lifetime of the image forming section.

Figure 11:
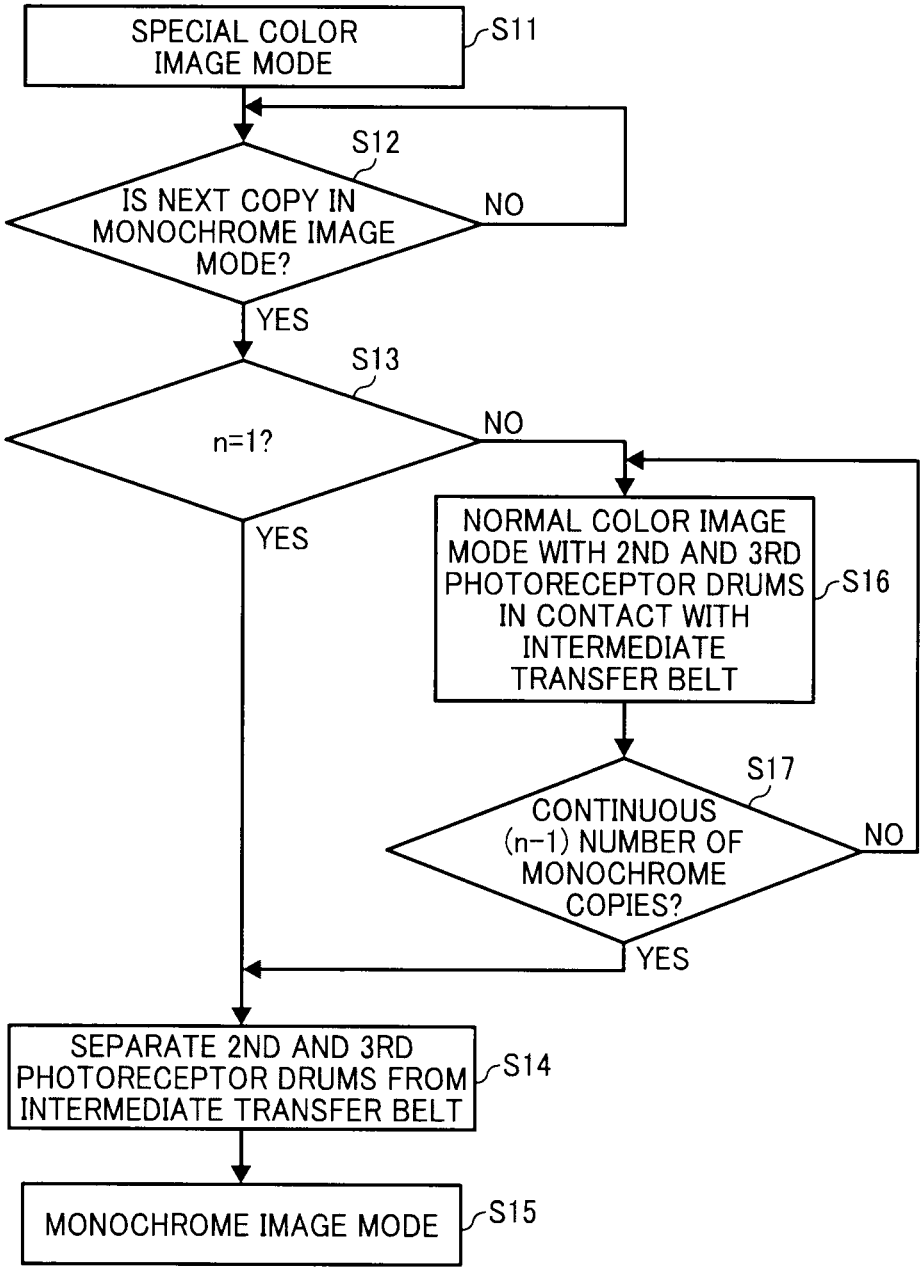
FIG. 11 is a flowchart showing another control during the continuous print operation.

FIG. 11 shows a specific control sequence concerning the aforementioned control during the continuous printing, which will be described hereinafter.

First, when image formation is performed by the special color image mode during the continuous printing (in step S11), it is determined if a next original document or image information is to be image-formed by the monochrome image mode (in step S12). As a result, if the next original document or image information is not image-formed by the monochrome image mode, printing operation is continued by the special color image mode.

By contrast, if in step S12, it is determined that the next original document or image information is to be image-formed by the monochrome image mode, it is further determined if the threshold value n is set to be 1 (one) (in step S13).

As a result, when it is determined that the threshold value n is set to be 1 (one), the second attach-detach unit 72 causes the second photoreceptor drums 1Y, 1M, and 1C to be detached from the intermediate transfer belt 8 and the third attach-detach unit 73 causes the third photoreceptor drum 1W to be detached from the intermediate transfer belt 8 (in step S14). Then, in the state as illustrated in FIG. 6, printing operation by the monochrome image mode is performed (in step S15).

By contrast, in step S13, when it is determined that the threshold value n is not set to be 1 (one), the detachment operation by the second attach-detach unit 72 to detach the second photoreceptor drums 1Y, 1M, and 1C and the third attach-detach unit 73 to detach the third photoreceptor drum 1W is not performed, and printing operation by the monochrome image mode is performed with the five photoreceptor drums 1Y, 1M, 1C, 1K, and 1W attached to the intermediate transfer belt 8 as illustrated in FIG. 4 (in step S16). Thereafter, after whether (n−1) number of sheets of original copies for the monochrome image mode have been printed or not is determined, the second attach-detach unit 72 performs detachment operation of the second photoreceptor drums 1Y, 1M, and 1C and the third attach-detach unit 73 performs detachment operation of the third photoreceptor drum 1W (in step S14). Then, in the state as illustrated in FIG. 6, printing is performed by the monochrome image mode (in step S15).

Meanwhile, in the above control sequence, if the threshold value n is set to be 0 (zero), even when there is/are an original document/copies for the monochrome image mode, printing is performed by the monochrome image mode in a state as illustrated in FIG. 4 in which five photoreceptor drums 1Y, 1M, 1C, 1K, and 1W are always contacted with the intermediate transfer belt 5.

Even when such a control as described above is performed, an experimental result similar to that as illustrated in FIGS. 9 and 10 was obtained. Specifically, when switching from the special color image mode to the monochrome image mode is done during the continuous printing, whether the second photoreceptor drums 1Y, 1M, and 1C and the third photoreceptor drum 1W should be detached from the intermediate transfer belt 8 may be selected depending on the number of sheets continuously printed by the monochrome image mode. Thus, without decreasing the productivity of the output image, the lifetime of the image forming sections 6Y, 6M, 6C, and 6W unnecessary for the monochrome image formation may be extended.

In the control as described above, during the continuous printing of the recording media P, when the special color image mode is switched to the monochrome image mode, and the detachment operation of the second photoreceptor drums 1Y, 1M, and 1C and the third photoreceptor drum 1W by the second attach-detach unit 72 and the third attach-detach unit 73 is not performed, it is preferred that the three developing sections of the image forming sections 6Y, 6M, and 6C for the color toner and the developing section of the image forming section 6W for the special toner (corresponding to the developing section 5Y in FIG. 2) be caused to stop driving. Specifically, in step S16 as illustrated in FIG. 11, the drive motor 61 to drive the three developing sections in the image forming sections 6Y, 6M, and 6C for the color toner is stopped. It is noted that the main drive motor to rotatably drive the second and third photoreceptor drums 1Y, 1M, 1C, and 1W is operated.

With this configuration, parts and components (such as developing rollers and conveyance screws) in the developing sections for the color toner and the special toner and the developer contained in the developing sections are prevented from being degraded.

In addition, when the driving of the developing sections for the color toner and the special toner is stopped, it is preferred that cleaning blades (each corresponding to the cleaning blade 2*a* in FIG. 2) of the image forming sections 6Y, 6M, 6C, and 6W for the color toner and the special toner be detached from the photoreceptor drums 1Y, 1M, 1C, and 1W, respectively. Specifically, in step S16 as illustrated in FIG. 11, the drive section 62 is controlled to detach the cleaning blade 2*a* in each of the image forming sections 6Y, 6M, 6C, and 6W from the corresponding photoreceptor drums 1Y, 1M, 1C, and 1W.

According to the above control, any adverse effect to cause the cleaning blade 2*a* to be raised up or damaged due to the increase in the sliding resistance between the photoreceptor drums 1Y, 1M, 1C, and 1W and the cleaning blade 2*a* resulting from the driving in a state in which the developing section is stopped driving and then the toner is not supplied from the developing section to the rotating photoreceptor drums 1Y, 1M, 1C, and 1W, may be prevented.

Herein, referring back to FIGS. 1, 3, and 4, the image forming apparatus 100 according to the present first embodiment is configured such that three second photoreceptor drums 1Y, 1M, and 1C (or the image forming sections 6Y, 6M, and 6C) are sandwiched by the first photoreceptor drum 1K (or the image forming section 6K9 and the third photoreceptor drum 1W (or the image forming section 1W). In addition, those five photoreceptor drums 1Y, 1M, 1C, 1K, and 1W (or the image forming sections 6Y, 6M, 6C, 6K, and 6W) are disposed parallel to the intermediate transfer belt 8. With such a configuration, the number of attach-detach unit to perform the above described three image modes may be smallest, whereby the image forming apparatus 100 itself may be manufactured at a low cost and made compact in size, the control of the attach-detach operation may be simplified, the time required for the detachment operation may be reduced, and any adverse effect related to the detachment operation is minimized.

In particular, since the first photoreceptor drum 1K (or the image forming section 6K) is disposed most downstream in the conveyance direction of the intermediate transfer belt 8 and the third photoreceptor drum 1W (or the image forming section 6W) is disposed most upstream in the conveyance direction of the intermediate transfer belt 8, the number of detachment means to detach the third photoreceptor drum 1W and the second photoreceptor drums 1Y, 1M, and 1C relative to the intermediate transfer belt 8 is made 2 (two), which makes the aforementioned effect more remarkable.

Further, since the first photoreceptor drum 1K (or the image forming section 6K) is disposed most downstream in the conveyance direction of the intermediate transfer belt 8, a first print time (denoting a duration of time from the start printing operation to completion of printing the first sheet) may be shortened. In addition, since the third photoreceptor drum 1W (or the image forming section 6W) is disposed most upstream in the conveyance direction of the intermediate transfer belt 8, the first print time in the normal color image mode may be substantially identical to the time in the image forming apparatus in which the image forming section 6W for the special color toner is not provided.

In addition, since the first photoreceptor drum 1K (or the image forming section 6K) is disposed most downstream in the conveyance direction of the intermediate transfer belt 8 and the third photoreceptor drum 1W (or the image forming section 6W) is disposed most upstream in the conveyance direction of the intermediate transfer belt 8, when switching from the special color image mode to the normal color image mode is performed during the continuous printing of the recording media P, detachment operation of the third photoreceptor drum 1W by the third attach-detach unit 73 (the first detachment means) is controlled to be performed after the toner image by the black toner formed on the first photoreceptor drum 1K has been transferred to the intermediate transfer belt 8. In performing such a control, even when vibration occurs to the intermediate transfer belt 8 due to the detachment operation of the third photoreceptor drum 1W by the third attach-detach unit 73 (the first detachment means), the vibration does not affect image formation on the photoreceptor drum 1Y, 1M, 1C, and 1K or the primary transfer of the toner images onto the intermediate transfer belt 8. Thus, the defective image due to the vibration of the intermediate transfer belt 8 may be prevented.

In the present first embodiment, transparent toner is used as a special toner, and white toner (in which white colorant is used) is also used as a special toner. Colored toner other than black, yellow, magenta, and cyan may be used as a special toner.

By using white toner as the special toner, a white image may be formed on a recording medium P which is not white in color such as colored paper or transparent sheet.

By using colored toner other than yellow, magenta, cyan, and black as the special toner, the color reproducibility in the output image is improved and the toner consumption is saved. For example, when the image using a special color such as a corporate color requiring color reproducibility in particular is formed frequently, it is better to prepare in advance the special color reproducing the specific mono-color, rather than reproducing the special color by superimposing the three colors of yellow, magenta, and cyan.

As described above, in the present first embodiment, after the switching from the special color image mode, depending on the number of sheets to be continuously printed by the normal color image mode or the monochrome image mode, the photoreceptor drum (or the image carrier) which is not used in the image formation is detached. According to this configuration, even when image formation is performed during continuous operation by switching between the various image modes, any abnormal image including color shift or uneven pitches on the output image is not occur and high productivity in the continuous printing and the longer lifetime of the image forming section may be collaterally realized.

Further, the effects of the present invention will be described in detail.

In the first embodiment of the present invention, when the special color image mode is switched to the normal color image mode or the monochrome image mode during continuous printing, whether the detachment of the third photoreceptor drum 1W is performed or not is selected depending on the number of sheet of the continuous print number by the normal color image mode or the monochrome image mode. Specifically, after switching, when the continuously printed number of sheets is small by the normal color image mode or the monochrome image mode, the detachment of the third photoreceptor drum 1W is not performed, thereby improving the productivity of the output image. By contrast, when the continuous print number by the normal color image mode or the monochrome image mode after switching is large, the detachment of the third photoreceptor drum 1W is performed, thereby extending the lifetime of the image forming section 6W for the special toner.

Specifically, when the number of sheets to be continuously printed is 10 or more, the detachment of the third photoreceptor drum 1W is performed after a tenth sheet has been printed, and the third photoreceptor drum 1W is not detached until a ninth sheet has been printed. Then, when the number of sheets to be printed by the normal color image mode is only a few, the decrease in the productivity due to the detachment operation of the third photoreceptor drum 1W can be obviated. By contrast, if the print number by the normal color image mode is large, for example, several hundreds in number, the third photoreceptor drum 1W is detached at the tenth sheet, thereby eliminating to have the image forming section 6W for the special toner print unnecessarily several hundreds of sheets by the white color image mode and preventing the lifetime of the image forming section 6W for the special toner from shortening.

In addition, when the number of sheets to be printed by the normal color image mode is a few and detachment of the third photoreceptor drum 1W is performed, the productivity decreases due to the time required for the detachment operation as well as the effect of longer lifetime of the image forming section 6W by the detachment operation of the third photoreceptor drum 1W is lost, since the image forming section 6W needs to be operated extra to a certain degree to prevent vibration of the intermediate transfer belt 8 during the detachment operation. Accordingly, when the number of sheets to be printed continuously is a few, detachment operation of the third photoreceptor drum 1W during the switching of the mode is omitted.

By contrast, when the number of sheet for continuous printing is large, if the third photoreceptor drum 1W is not detached during the switching of the mode, the larger the number of sheets of the continuous printing is, the more uselessly the image forming section 6*w* for the special toner operates. Then, the lifetime of the image forming section 6W is caused to be shortened. In the present first embodiment, because the third photoreceptor drum 1*w* is detached and the image forming section 1*w* for the special toner is stopped operation, the above problem may be solved. In addition, if the number of sheets of continuous printing by the normal color image mode is large, the time to be taken for the detachment operation of the third photoreceptor drum 1W is minimal compared to the entire operation, and even though the detachment operation of the third photoreceptor drum 1W is performed, the productivity in the output image is rarely decreased.

In addition, the present first embodiment according to the present invention is applied to the image forming apparatus 100 of the indirect transfer method employing the intermediate transfer belt 8 used as a transfer target member. Specifically, the image forming apparatus 100 forms an image on the recording medium P via the primary transfer process and the secondary transfer process. However, the present invention may be applied to such a type of the image forming apparatus in which toner images on the photoreceptor drums 1Y, 1M, 1C, 1K, and 1W are directly formed on the recording medium P superimposedly. In this type of apparatus also, the first detachment means to detach the third photoreceptor drum 1W relatively from the recording medium P as a transfer target, and the second detachment means to detach the second photoreceptor drums 1Y, 1M, 1C and the third photoreceptor drum 1W relatively from the recording medium P as a transfer target are provided, and the controls similar to those performed in the present first embodiment are performed upon switching of the image mode during continuous printing, whereby the same effect as in the first embodiment may be obtained.

In the present first embodiment, the number of the image forming section 6W for the special toner (or the third photoreceptor drum 1W) is one; however, a plurality of image forming sections 6W for the special toner (or the third photoreceptor drum 1W) maybe provided. For example, in addition to the image forming section 6W using the transparent toner disposed opposite the intermediate transfer belt 8, another image forming section 6W using the white toner may be provided. In this case, a first special color image mode using the transparent toner as a fifth color and a second special color image mode using the white toner as a fifth color maybe selectively provided, and it is configured to control the entire apparatus similarly to the case of the present first embodiment when switching from the respective special color image modes to the normal color image mode or the monochrome image mode is performed, whereby the similar effect to the present first embodiment can be obtained.

Figure 12:
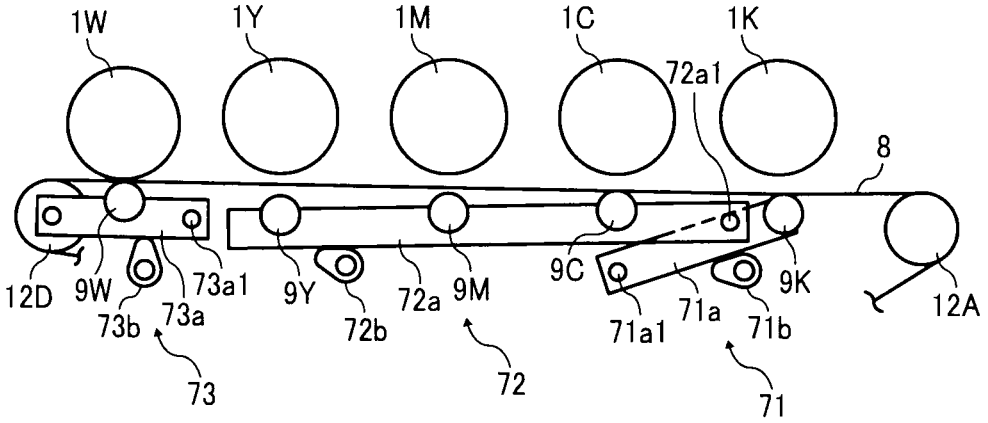
FIG. 12 is a diagram showing a state in which only the third photoreceptor drum contacts the intermediate transfer belt in an image forming apparatus as a second embodiment of the present invention.

With reference to FIG. 12, a preferred second embodiment of the present invention will now be described.

FIG. 12 shows a state in which only the third photoreceptor drum 1W comes in contact with the intermediate transfer belt 8.

The second embodiment is different from the first embodiment in that the second embodiment includes a special image mode in which a toner image using only the special toner is to be created, in addition to the special color image mode, the normal color image mode, and the monochrome image mode.

The image forming apparatus according to the second embodiment is identical with that according to the first embodiment in that the special color image mode, the normal color image mode, and the monochrome image mode can be selected, and detachment of the photoreceptor drum (or the image carrier) not used in the image formation is performed depending on the number of sheet to be continuously printing by the normal color image mode and/or the monochrome image mode after switching from the special color image mode.

The image forming apparatus according to the second embodiment is capable of selecting the special image mode in which only the toner image by the special toner is formed. Specifically, the special image mode in which only the toner image formed on the third photoreceptor drum 1W (the third image carrier) is transferred to the intermediate transfer belt 8 (the transfer target member) can be selected in the second embodiment.

Specifically, in a printing operation with regard to a sheet of original document, in a state as illustrated in FIG. 12 in which three attach-detach units 71 through 73 are controlled such that the third photoreceptor drum 8 only comes in contact with the intermediate transfer belt 8 and the other four photoreceptor drums 1Y, 1M, 1C, and 1K are detached from the intermediate transfer belt 8, the image forming process by the special image mode using the special toner only is performed. Such a special image mode is either automatically selected by that the original document set in the original document feed section (not shown) in the image forming apparatus body 100 is optically sensed or manually selected by the user to manipulate the operation panel (not shown) provided on the apparatus body 100. Specifically, it is determined that the image formation using the black toner or the image formation using the four colors of toner is unnecessary and that the image forming using the special toner only, that is, the image formation of the special image is necessary from the original document set on the apparatus body 100, the special image mode is automatically or manually selected.

Such a special image mode is selected when a secondary print process is to be applied to a recording medium P on which print operation has been completed (that is, a recording medium P on which an image has been already formed) by this image forming apparatus 100 or another type of image forming apparatus. For example, when post process to adjust image glossiness or to apply concave-convex surface treatment is added to the recording medium P on which a full-color image has been formed, the special image mode is selected.

Herein, the first attach-detach unit 71 and the second attach-detach unit 72 serve as a third detachment means to detach the first photoreceptor drum 1K and the second photoreceptor drums 1Y, 1M, and 1C relative to the intermediate transfer belt 8. Specifically, when the first attach-detach unit 71 and the second attach-detach unit 72 transit from the state as illustrated in FIG. 4 to the state as illustrated in FIG. 12, the first photoreceptor drum 1K and the second photoreceptor drums 1Y, 1M, and 1C are detached from the intermediate transfer belt 8 relatively, and the third photoreceptor drum 1W only comes in contact with the intermediate transfer belt 8. Then, in a print operation to one original document, when the special image mode is selected, the image forming process is performed in a state as illustrated in FIG. 12.

Herein, also in the present second embodiment, when the plurality of original copies (or image information) is set to the original document feed section, one print job may be performed while switching the image mode between various image modes, during the continuous printing.

Specifically, when various types of original copies exist mixedly, an optimal image mode for each original document is automatically selected from between the special color image mode, normal color image mode, monochrome image mode, and special image mode.

To repeat, the special image mode is an image mode in which the toner image formed on the third photoreceptor drum 1W only is transferred to the intermediate transfer belt 8.

Then, in the present second embodiment, when switching from the special color image mode to the special image mode is performed during the continuous printing, detachment operation by the first attach-detach unit 71 and the second attach-detach unit 72 (the third detachment means in combination) depending on the number of sheets of the recording media P to be continuously printed by the special image mode. Specifically, when continuous printing is performed and the special color image mode is switched to the special image mode, after the number of sheets of the recording media P to be continuously printed by the special image mode has reached a predetermined threshold value n, the first attach-detach unit 71 and the second attach-detach unit 72 (the third detachment means in combination) are controlled to perform the detachment operation. In other words, during one print job in which a plurality of types of original copies are sequentially and automatically conveyed and read, when the original document/copies or image information for the special color image mode is switched to the original document/copies or image information for the special image mode, the first attach-detach unit 71 and the second attach-detach unit 72 (the third detachment means in combination) are controlled to perform the detachment operation after the number of prints of the recording media P image-formed by the special image mode has reached a predetermined threshold value.

Specifically, when switching of the image mode from the special color image mode to the special image mode, until the number of sheets of the recording media P to be continuously printed by the special image mode reaches a predetermined threshold value, the detachment operation of the first attach-detach unit 71 and the second attach-detach unit 72 (the third detachment means in combination) is not performed. In this case, in a state in which all five photoreceptor drums 1Y, 1M, 1C, 1K, and 1W come in contact with the intermediate transfer belt 8, image formation by the special toner (i.e., the special image mode) is performed. Then, after the number of sheets of recording media P continuously printed by the special image mode has reached a predetermined threshold value n, the detachment operation by the first attach-detach unit 71 and the second attach-detach unit 72 (the third detachment means in combination) is swiftly performed, and the image formation by the special toner (the special image mode) is performed in a state in which all five photoreceptor drums 1Y, 1M, 1C, 1K, and 1W come in contact with the intermediate transfer belt 8. Meanwhile, during the image formation by the special image mode in a state in which all five photoreceptor drums 1Y, 1M, 1C, 1K, and 1W come in contact with the intermediate transfer belt 8, image formation by the image forming sections 6Y, 6M, 6C, and 6K other than the image forming section 6W is not performed, and reverse voltage is applied to the corresponding primary transfer rollers 9Y, 9M, 9C, and 9K so that the toner adhesion to the intermediate transfer belt 8 from the first photoreceptor drum 1K and the second photoreceptor drums 1Y, 1M, and 1C is prevented.

According to the control as described above, in the continuous printing while various image modes being switched, abnormal images including color shift or uneven pitches do not occur on the output images, and while reducing to a certain degree decease in the productivity during the continuous printing, the longer lifetime of the image forming sections 6Y, 6M, 6C, and 6K can be attained. Besides, specific effects of the present second embodiment are similar to those described with reference to FIGS. 9 and 10.

Here, the predetermined threshold value n can be set variably to zero or an arbitrary natural number by a service person or a user who manipulates on the display panel, not shown, provided on the apparatus body 100, whereby the image forming apparatus according to the present second embodiment can cope with the needs of various users widely from a type of the user who prioritizes a longer lifetime of the image forming section rather than the productivity in the continuous printing to another type of the user who prioritizes the productivity in the continuous printing rather than the longer lifetime of the image forming section.

In the above control, when during the continuous printing, switching from the special color image mode to the special image mode is performed and four photoreceptor drums 1Y, 1M, 1C and 1K are not detached from the intermediate transfer belt 8 by the first attach-detach unit 71 and the second attach-detach unit 72 (the third detachment means in combination), it is preferred that the driving of the developing section (see the developing section 5Y in FIG. 2) corresponding to each of the four image forming sections 6Y, 6M, 6C, and 6K be halted.

With this configuration, parts and components (such as developing rollers and conveyance screws) in the developing section not related to the special image mode and the developer contained in the developing section are prevented from being degraded.

When the driving of the developing section not related to the special image mode is stopped, it is preferred that the cleaning blade (corresponding to the cleaning blade 2*a* in FIG. 2) of the corresponding each of the four image forming sections 6Y, 6M, 6C, and 6K be detached from the corresponding each of the photoreceptor drums 1Y, 1M, 1C, and 1K.

According to the above control, any adverse effect to cause the cleaning blade 2*a* to be raised up or damaged due to the increase in the sliding resistance between the photoreceptor drums 1Y, 1M, 1C, and 1K and the cleaning blade 2*a* resulting from the driving in a state in which the developing section is stopped driving and then the toner is not supplied from the developing section to the rotating photoreceptor drums 1Y, 1M, 1C, and 1K, may be prevented.

As described above, in the present second embodiment, after switching from the special color mode during the continuous printing operation, the detachment operation of the photoreceptor drums or image carriers not used for the image formation is performed depending on the number of sheets to be continuously printed by the normal color image mode, monochrome image mode, and special image mode. With such a control, even when the continuous printing is performed while the various image modes being switched, abnormal images including color shift or uneven pitches is prevented from occurring in the output images. Further, the higher productivity in the continuous printing and the longer lifetime of the image forming sections can be collaterally achieved.

In each of the aforementioned embodiments, an intermediate transfer belt 8 is used as an intermediate transfer member, but an intermediate transfer drum may be used as an intermediate transfer member.

The image forming apparatus 100 used in the present invention was a copier in which a plurality of types of original copies can be set; however, the present invention may be applied to a printer capable of continuously printing various types of image information sent from a host computer and the like.

Even in such a case, the same effects as exerted in the aforementioned embodiments may be obtained.

Additional modifications and variations of the present invention are possible in light of the above teachings. It is therefore to be understood that, within the scope of the appended claims, the invention may be practiced other than as specifically described herein.

What is claimed is:

1. An image forming apparatus to form an image on a recording medium, comprising:

a first image carrier on which a toner image using black toner is formed;

a plurality of second image carriers on each of which a toner image using color toner forming a color image is formed;

a third image carrier on which a toner image of a special color different from the black toner and the color toner is formed;

an endless rotary transfer target member, disposed opposite each of the first to third image carriers, on which the toner images formed by the first to third image carriers are superimposed;

a first detachment unit to detach only the third image carrier from the transfer target member;

a second detachment unit to detach the plurality of second image carriers and the third image carrier from the transfer target member; and a controller configured to selectively switch the image forming apparatus between a monochrome image mode, a normal color image mode, and a special color image mode, wherein the first detachment unit and the second detachment unit control a detachment operation based on a number of recording media continuously printed in the normal color image mode or the monochrome image mode, when switching from the special color image mode to either the normal color image mode or the monochrome image mode is performed during continuous printing of the recording media;

the special color image mode is a mode in which the toner images formed respectively on the first image carrier, the plurality of second image carriers, and the third image carrier are totally, superimposedly transferred to the transfer target member;

the normal color image mode is a mode in which the toner images formed respectively on the first image carrier and the plurality of second image carriers are superimposedly transferred to the transfer target member;

the monochrome image mode is a mode in which the toner image formed on the first image carrier is transferred to the transfer target member and when switching from the special color image mode to the normal color image mode is performed during the continuous printing of the recording media and the first detachment unit does not perform detachment operation, a developing section to develop a latent image formed on the third image carrier is stopped.

2. The image forming apparatus as claimed in claim 1, wherein when switching from the special color image mode to either the normal color image mode or the monochrome image mode during the continuous printing of the recording medium, the first detachment unit and the second detachment unit performs detachment operation after the number of continuously printed recording media in the normal color image mode or the monochrome image mode reaches a selectable predetermined threshold value.

3. The image forming apparatus as claimed in claim 2, wherein the selectable predetermined threshold value is zero or an arbitrary natural number.

4. The image forming apparatus as claimed in claim 1, further comprising a cleaning blade to clean residual toner on the third image carrier while contacting it, wherein, when the developing section is stopped, the cleaning blade is separated from the third image carrier.

5. The image forming apparatus as claimed in claim 1, further comprising:

a first attach-detach unit to detach the first image carrier relative to the target transfer member;

a second attach-detach unit to detach the plurality of second image carriers from the target transfer member; and a third attach-detach unit to detach the third image carrier relative to the target transfer member, wherein the first detachment unit causes the third attach-detach unit to operate, and the second detachment unit causes the second attach-detach unit and the third attach-detach unit to operate.

6. The image forming apparatus as claimed in claim 1, wherein the special toner is transparent toner or white toner.

7. The image forming apparatus as claimed in claim 1, wherein the color toner to form the color image comprises yellow, magenta, and cyan toner; and the special toner is color toner different from the black toner and the three colors of toner.

8. The image forming apparatus as claimed in claim 1, further comprising a secondary transfer member to secondarily transfer a toner image primarily transferred to an intermediate transfer belt, onto the recording medium, wherein the transfer target member is the intermediate transfer belt disposed opposite each of the first image carrier, the plurality of second image carriers, and the third image carrier.

9. An image forming apparatus to form an image on a recording medium, comprising:

a first image carrier on which a toner image using black toner is formed;

a plurality of second image carriers on each of which a toner image using color toner forming a color image is formed;

a third image carrier on which a toner image of a special color different from the black toner and the color toner is formed;

an endless rotary transfer target member, disposed opposite each of the first to third image carriers, on which the toner images formed by the first to third image carriers are superimposed;

a first detachment unit to detach only the third image carrier from the transfer target member;

a second detachment unit to detach the plurality of second image carriers and the third image carrier from the transfer target member; and a controller configured to selectively switch the image forming apparatus between a monochrome image mode, a normal color image mode, and a special color image mode, wherein the first detachment unit and the second detachment unit control the detachment operation based on a number of recording media continuously printed in the normal color image mode or the monochrome image mode, when switching from the special color image mode to either the normal color image mode or the monochrome image mode is performed during continuous printing of the recording media;

the special color image mode is a mode in which the toner images formed respectively on the first image carrier, the plurality of second image carriers, and the third image carrier are totally, superimposedly transferred to the transfer target member;

the normal color image mode is a mode in which the toner images formed respectively on the first image carrier and the plurality of second image carriers are superimposedly transferred to the transfer target member; and the monochrome image mode is a mode in which the toner image formed on the first image carrier is transferred to the transfer target member, the image forming apparatus further comprising a developing section to develop the latent image formed on the third image carrier and a plurality of developing sections to develop latent images formed on the plurality of second image carrier, wherein when switching from the special color image mode to the monochrome image mode is performed during the continuous printing of the recording media, and the second detachment unit does not perform detachment operation, the developing section to develop the latent image formed on the third image carrier and the plurality of developing sections to develop the latent images formed on the plurality of second image carriers are stopped.

10. The image forming apparatus as claimed in claim 9, wherein when the developing sections are stopped, a cleaning blade to clean residual toner on the third image carrier while contacting it is detached from the third image carrier, and a plurality of cleaning blades to clean residual toner on the plurality of second image carriers respectively while contacting each of the carriers are detached from the plurality of second image carriers.

11. An image forming apparatus to form an image on a recording medium, comprising:

a first image carrier on which a toner image using black toner is formed;

a plurality of second image carriers on each of which a toner image using color toner forming a color image is formed;

a third image carrier on which a toner image of a special color different from the black toner and the color toner is formed;

an endless rotary transfer target member, disposed opposite each of the first to third image carriers, on which the toner images formed by the first to third image carriers are superimposed;

a first detachment unit to detach only the third image carrier from the transfer target member;

a second detachment unit to detach the plurality of second image carriers and the third image carrier from the transfer target member; and a controller configured to selectively switch the image forming apparatus between a monochrome image mode, a normal color image mode, and a special color image mode, wherein the first detachment unit and the second detachment unit control the detachment operation based on a number of recording media continuously printed in the normal color image mode or the monochrome image mode, when switching from the special color image mode to either the normal color image mode or the monochrome image mode is performed during continuous printing of the recording media;

the special color image mode is a mode in which the toner images formed respectively on the first image carrier, the plurality of second image carriers, and the third image carrier are totally, superimposedly transferred to the transfer target member;

the normal color image mode is a mode in which the toner images formed respectively on the first image carrier and the plurality of second image carriers are superimposedly transferred to the transfer target member;

the monochrome image mode is a mode in which the toner image formed on the first image carrier is transferred to the transfer target member;

the plurality of second image carriers are disposed between the first image carrier and the third image carrier, and the first to third image carriers are disposed parallel to the transfer target member;

the first image carrier is disposed at an extreme downstream position in a conveyance direction of the transfer target member, and the third image carrier is disposed at an extreme upstream position in the conveyance direction of the transfer target member; and when switching from the special color image mode to the normal color image mode is performed during the continuous printing of the recording media, the first detachment unit performs detachment operation after the toner image of the black toner formed on the first image carrier has been transferred to the transfer target member.

12. An image forming apparatus to form an image on a recording medium, comprising:

a first image carrier on which a toner image using black toner is formed;

a plurality of second image carriers on each of which a toner image using color toner forming a color image is formed;

a third image carrier on which a toner image of a special color different from the black toner and the color toner is formed;

an endless rotary transfer target member, disposed opposite each of the first to third image carriers, on which the toner images formed by the first to third image carriers are superimposed;

a first detachment unit to detach only the third image carrier from the transfer target member;

a second detachment unit to detach the plurality of second image carriers and the third image carrier from the transfer target member; and a controller configured to selectively switch the image forming apparatus between a monochrome image mode, a normal color image mode, and a special color image mode, wherein the first detachment unit and the second detachment unit control the detachment operation based on a number of recording media continuously printed in the normal color image mode or the monochrome image mode, when switching from the special color image mode to either the normal color image mode or the monochrome image mode is performed during continuous printing of the recording media;

the special color image mode is a mode in which the toner images formed respectively on the first image carrier, the plurality of second image carriers, and the third image carrier are totally, superimposedly transferred to the transfer target member;

the normal color image mode is a mode in which the toner images formed respectively on the first image carrier and the plurality of second image carriers are superimposedly transferred to the transfer target member;

the monochrome image mode is a mode in which the toner image formed on the first image carrier is transferred to the transfer target member; and wherein a special image mode to transfer only the toner image formed on the third image carrier can be selectable.

13. The image forming apparatus as claimed in claim 12, further comprising a third detachment unit to detach the first image carrier and the plurality of second image carriers relative to the transfer target member, the third detachment unit being configured to operate the first attach-detach unit to detach the first image carrier relative to the transfer target member and the second attach-detach unit to detach the plurality of second image carriers relative to the transfer target member.

14. The image forming apparatus as claimed in claim 13, wherein switching from the special color image mode to the special image mode during the continuous printing of the recording media is performed, the third detachment unit performs the detachment operation after a number of continuously printed recording media in the special image mode has reached the predetermined threshold value.

* * * * *